US010385522B1

(12) United States Patent
Ellwein et al.

(10) Patent No.: US 10,385,522 B1
(45) Date of Patent: Aug. 20, 2019

(54) MATERIAL FEED SYSTEM

(71) Applicant: Caterpillar Paving Products Inc., Brooklyn Park, MN (US)

(72) Inventors: Jacob Ryan Ellwein, Oak Grove, MN (US); Ronald D. Wilson, Maple Grove, MN (US); Steven Paul Goutermont, Saint Michael, MN (US)

(73) Assignee: Caterpillar Paving Products Inc., Brooklyn Park, MN (US)

( * ) Notice: Subject to any disclaimer, the term of this patent is extended or adjusted under 35 U.S.C. 154(b) by 0 days.

(21) Appl. No.: 15/905,876

(22) Filed: Feb. 27, 2018

(51) Int. Cl.
*E01C 19/00* (2006.01)
*E01C 19/40* (2006.01)
*E01C 19/48* (2006.01)

(52) U.S. Cl.
CPC ..... *E01C 19/405* (2013.01); *E01C 19/48* (2013.01)

(58) Field of Classification Search
CPC ..... E01C 19/405; E01C 19/48
USPC ..... 404/72, 75, 84.05, 118
See application file for complete search history.

(56) References Cited

U.S. PATENT DOCUMENTS 3,967,912 A 7/1976 Parker
4,012,160 A 3/1977 Parker
5,356,238 A * 10/1994 Musil ..... E01C 19/008 404/101
5,575,583 A 11/1996 Grembowicz et al.
8,469,630 B2 6/2013 Olson et al.
9,045,871 B2 * 6/2015 Graham ..... E01C 19/4873
2003/0194273 A1 * 10/2003 Lloyd ..... E01C 23/065 404/83
2012/0288328 A1 * 11/2012 Minich ..... E01C 23/07 404/72
2013/0223927 A1 * 8/2013 Mings ..... G01S 15/88 404/72
2014/0099165 A1 4/2014 Smieja
2016/0024725 A1 * 1/2016 Frelich ..... E01C 19/48 404/72
2017/0030030 A1 * 2/2017 Frelich ..... E01C 7/00
2017/0314215 A1 11/2017 Graham et al.

* cited by examiner

*Primary Examiner* — Raymond W Addie
(74) *Attorney, Agent, or Firm* — Schwegman, Lundberg & Woessner

(57) ABSTRACT

A material feed system for a paving machine includes a first sensor assembly, a second sensor assembly, and a controller configured to independently operate each of a left material feed mechanism and a right material feed mechanism with respect to one another and, selectively, in a first mode and a second mode. In the first mode, a speed of each of a left auger, a left conveyor, a right auger, and a right conveyor is automatically adjusted. In the second mode, the speed of at least one of the left auger, the left conveyor, the right auger, and the right conveyor is manually set by an operator input, one of the left material feed mechanism and the right material feed mechanism is operated in the first mode, and the other of the left material feed mechanism and the right material feed mechanism is simultaneously operated in the second mode.

20 Claims, 6 Drawing Sheets

MATERIAL FEED SYSTEM

TECHNICAL FIELD

The present disclosure relates to a material feed system. More particularly, the present disclosure relates to the material feed system associated with a paving machine.

BACKGROUND

Typically, an asphalt paving machine includes a material feed system installed thereon. The material feed system may feed asphalt from a hopper portion of the machine to one or more augers for spreading the asphalt on a ground surface. The material feed system may generally include a left mechanism and a right mechanism, such that each of the left mechanism and the right mechanism may include a conveyor and an auger. Also, each of the left mechanism and the right mechanism may include one or more sensors associated therewith. In some instances, the material feed system may be configured to be operated in an automated or semi-automated manner utilizing the one or more sensors associated with the left mechanism and the right mechanism. This automated mode may utilize two, four, or some other number of sensors to control an operation of the material feed system. Alternately, the material feed system may be operated in a manual mode in which no sensors may be utilized.

However, in many situations, when one of the sensors of either the left mechanism or the right mechanism may be damaged, an operator may be forced to operate the material feed system in the manual mode. This zero-sensor mode represents a full manual mode of operation, such that each of the left mechanism and the right mechanism may be operated manually by the operator. However, the zero-sensor mode of operation may result in increased operator intervention, increased operator dependence, increased operator fatigue, increased fluctuation in mat depth and smoothness, reduced product quality, and the like. Hence, there is a need for an improved configuration of the material feed system for such paving machines.

U.S. Pat. No. 3,967,912 describes a control means for independently driving two feed conveyors and two spreader augers each by its own drive motor. The control means for each feed conveyor includes a sensor at a discharge end of the feed conveyor and means responsive to changes in a level of a paving material at the sensor for proportionally increasing a drive speed of the conveyor as the level drops and proportionally decreasing the drive speed of the conveyor as the level rises. The control means for each auger includes a sensor adjacent a discharge end of the auger and means responsive to changes in a level of the paving material at the sensor for proportionally increasing a drive speed of the auger as the level drops and proportionally decreasing the drive speed of the auger as the level rises.

SUMMARY OF THE DISCLOSURE

In an aspect of the present disclosure, a material feed system for a paving machine is illustrated. The paving machine includes a hopper for holding a volume of paving material. The paving machine also includes a left material feed mechanism. The left material feed mechanism includes a left auger and a left conveyor provided in association with the left auger. The paving machine further includes a right material feed mechanism. The right material feed mechanism includes a right auger and a right conveyor provided in association with the right auger. The material feed system includes a first sensor assembly provided in association with one of the left auger and the left conveyor. The first sensor assembly is configured to generate a signal indicative of an amount of paving material in the left material feed mechanism. The material feed system also includes a second sensor assembly provided in association with one of the right auger and the right conveyor. The second sensor assembly is configured to generate a signal indicative of an amount of paving material in the right material feed mechanism. The material feed system further includes a controller communicably coupled to each of the first sensor assembly, the left auger, the left conveyor, the second sensor assembly, the right auger, and the right conveyor. The controller is configured to selectively receive the signal indicative of the amount of paving material in the left material feed mechanism from the first sensor assembly. The controller is also configured to selectively receive the signal indicative of the amount of paving material in the right material feed mechanism from the second sensor assembly. The controller is further configured to independently operate each of the left material feed mechanism and the right material feed mechanism with respect to one another and, selectively, in a first mode and a second mode. In the first mode, a speed of each of the left auger, the left conveyor, the right auger, and the right conveyor is automatically adjusted in response to the first sensor assembly and the second sensor assembly respectively. In the second mode, the speed of at least one of the left auger, the left conveyor, the right auger, and the right conveyor is manually set by an operator input, one of the left material feed mechanism and the right material feed mechanism is operated in the first mode, and the other of the left material feed mechanism and the right material feed mechanism is simultaneously operated in the second mode.

In another aspect of the present disclosure, a method for controlling a material feed system associated with a paving machine is illustrated. The material feed system includes a left material feed mechanism. The left material feed mechanism includes a left auger and a left conveyor. The material feed system also includes a right material feed mechanism. The right material feed mechanism includes a right auger and a right conveyor. The method includes selectively receiving a signal indicative of an amount of paving material in the left material feed mechanism from a first sensor assembly. The method includes selectively receiving a signal indicative of an amount of paving material in the right material feed mechanism from a second sensor assembly. The method also includes independently operating each of the left material feed mechanism and the right material feed mechanism with respect to one another and, selectively, in a first mode and a second mode. In the first mode, a speed of each of the left auger, the left conveyor, the right auger, and the right conveyor is automatically adjusted in response to the first sensor assembly and the second sensor assembly respectively. In the second mode, the speed of at least one of the left auger, the left conveyor, the right auger, and the right conveyor is manually set by an operator input, one of the left material feed mechanism and the right material feed mechanism is operated in the first mode, and the other of the left material feed mechanism and the right material feed mechanism is simultaneously operated in the second mode.

In yet another aspect of the present disclosure, a method for controlling a material feed system associated with a paving machine is illustrated. The material feed system includes a left material feed mechanism. The left material feed mechanism includes a left auger and a left conveyor. The material feed system also includes a right material feed mechanism. The right material feed mechanism also includes a right auger and a right conveyor. The method includes selectively receiving a signal indicative of an amount of paving material in the left material feed mechanism from a left auger sensor. The method also includes selectively receiving a signal indicative of an amount of paving material in the right material feed mechanism from a right auger sensor. The method further includes independently operating each of the left material feed mechanism and the right material feed mechanism with respect to one another and, selectively, in a first mode and a second mode. In the first mode, a speed of each of the left auger, the left conveyor, the right auger, and the right conveyor is automatically adjusted in response to the left auger sensor and the right auger sensor respectively. In the second mode, the speed of at least one of the left auger, the left conveyor, the right auger, and the right conveyor is manually set by an operator input, one of the left material feed mechanism and the right material feed mechanism is operated in the first mode, and the other of the left material feed mechanism and the right material feed mechanism is simultaneously operated in the second mode.

Other features and aspects of this disclosure will be apparent from the following description and the accompanying drawings.

DETAILED DESCRIPTION

Figure 1:
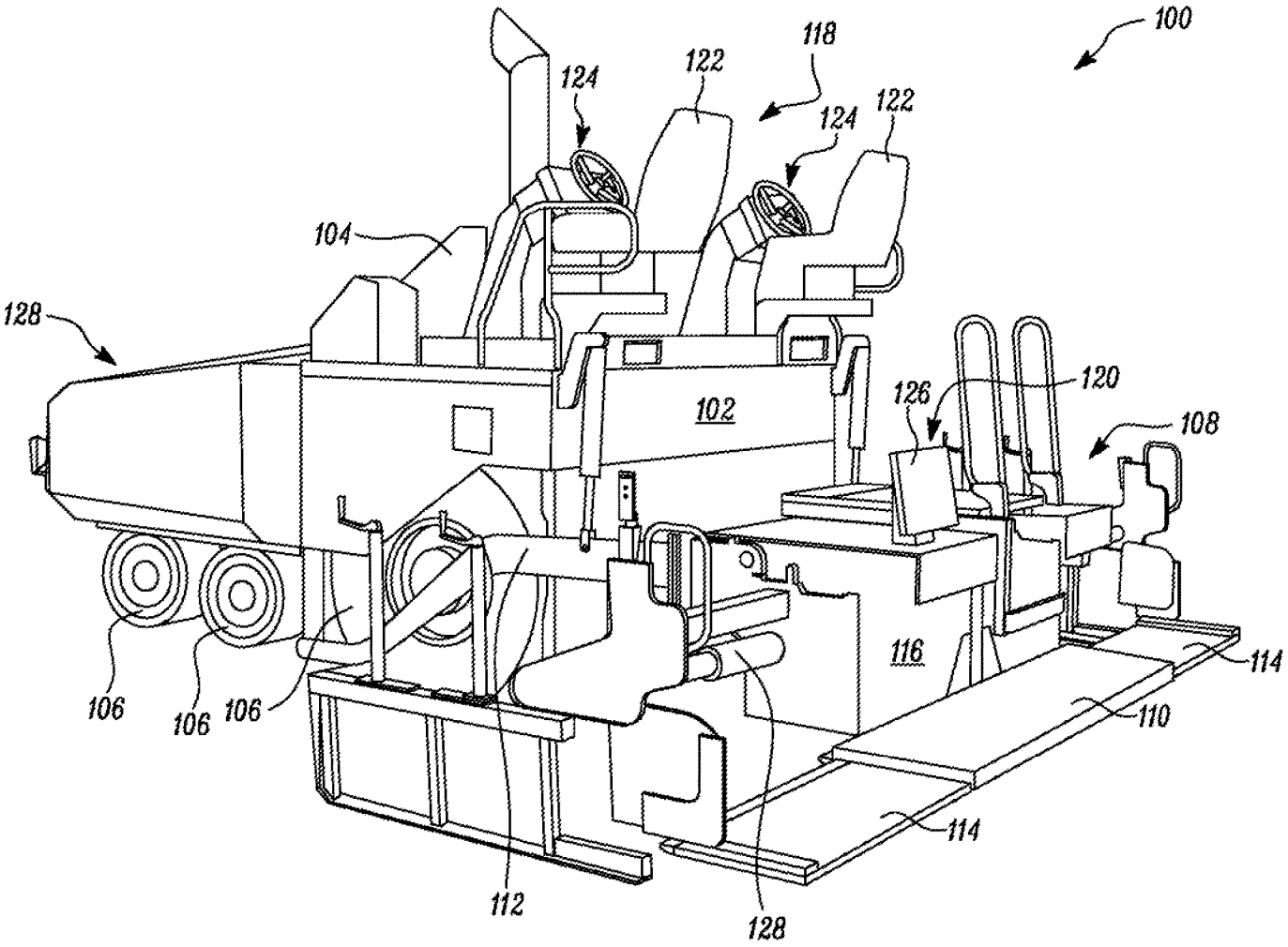
FIG. 1 is a perspective view of an exemplary machine, according to one embodiment of the present disclosure.

Wherever possible, the same reference numbers will be used throughout the drawings to refer to the same or the like parts. Referring to FIG. 1, an exemplary machine 100 is illustrated. More specifically, the machine 100 is a paving machine. The machine 100 includes a frame 102. The frame 102 is adapted to support various components of the machine 100 thereon. The machine 100 includes an enclosure 104 mounted on the frame 102. The enclosure 104 is adapted to enclose a power source (not shown) therein. The power source may be any power source known in the art, such as an internal combustion engine, batteries, motor, and so on. The power source is adapted to provide power to the machine 100 for operational and mobility requirements.

The machine 100 also includes a plurality of ground engaging members 106 movably coupled to the frame 102. In the illustrated embodiments, the ground engaging members 106 include wheels. In other embodiments, the ground engaging members 106 may include tracks. The ground engaging members 106 are adapted to support and provide maneuverability to the machine 100 on a ground surface. The machine 100 also includes a screed assembly 108 mounted on the frame 102. The screed assembly 108 will be hereinafter interchangeably referred to as the "assembly 108". The assembly 108 includes a main screed 110 movably mounted on the frame 102. More specifically, the main screed 110 is coupled to an end of a tow arm 112. The other end of the tow arm 112 may be pivotally connected to the frame 102 of the machine 100 in a manner for towing the assembly 108. The assembly 108 may pivot about the pivotal connection with the frame 102 to float freely over an asphalt surface being paved.

The assembly 108 also includes one or more screed extensions 114 mounted on the main screed 110. The screed extensions 114 are movably coupled to the main screed 110. In one embodiment, the main screed 110 may include a screed extension carriage 116, for mounting the screed extensions 114. In some embodiments, the screed extensions 114 may be mounted rearwardly of the main screed 110. In yet other embodiments, the screed extensions 114 may be mounted in front of the main screed 110, based on application requirements.

The machine 100 also includes a machine operator station 118 mounted on the frame 102. The machine operator station 118 is configured to control various functions associated with the machine 100 and, in some embodiments, functions associated with the assembly 108. The machine 100 also includes a screed operator station 120. The screed operator station 120 is configured to control various functions associated with the assembly 108 and, in some embodiments, functions associated with the machine 100. The machine operator station 118 may include one or more seats 122 for an operator. Further, each of the machine operator station 118 and the screed operator station 120 may include respective operator interfaces 124, 126. The operator interfaces 124, 126 may be configured to receive various inputs from the operator and for displaying information to the operator during operation of the machine 100 and/or the assembly 108.

Figure 2:
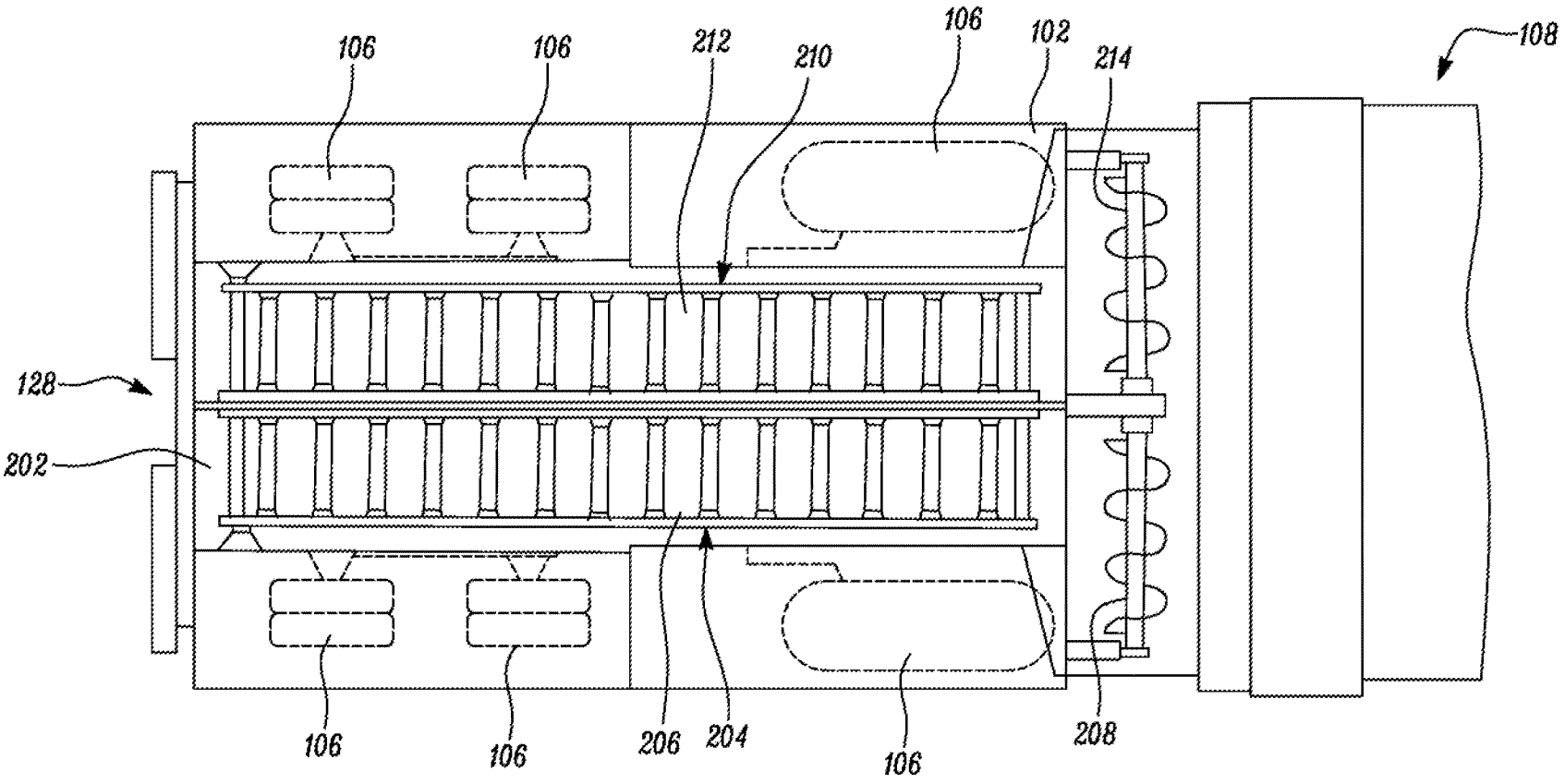
FIG. 2 is a schematic top view of a portion of the machine of FIG. 1, according to one embodiment of the present disclosure.

The machine 100 also includes a material feed system 128 mounted on the frame 102. The material feed system 128 will be hereinafter interchangeably referred to as the "system 128". The system 128 is adapted to receive paving material on the machine 100 and transfer the paving material from one portion of the machine 100 to another. Referring to FIG. 2, a perspective view of the system 128 is illustrated. The system 128 includes a hopper 202. The hopper 202 is adapted to hold a volume of the paving material therein received from an external source (not shown), such as a truck or transfer vehicle, for example.

The system 128 includes a left material feed mechanism 204. The left material feed mechanism 204 will be hereinafter interchangeably referred to as the "left mechanism 204". The left mechanism 204 includes a left conveyor 206 and a left auger 208. The left auger 208 is disposed rearwardly and adjacent to an end of the left conveyor 206. The left conveyor 206 transfers the paving material from the hopper 202 to the left auger 208 in a direction generally parallel to a direction of travel of the machine 100. The left conveyor 206 may be any conveying element known in the art, such as a belt type conveyor, a feeder bar type conveyor, and so on. The left auger 208 is adapted to distribute the paving material in front of the assembly 108 and laterally in a direction generally perpendicular to the direction of travel of the machine 100. The left auger 208 may be any conveying element known in the art, such as a screw type conveyor, a rotating type conveyor, and so on.

The system 128 also includes a right material feed mechanism 210. The right material feed mechanism 210 will be hereinafter interchangeably referred to as the "right mechanism 210". The right mechanism 210 includes a right conveyor 212 and a right auger 214. The right conveyor 212 is disposed rearwardly and adjacent to an end of the right conveyor 206. The right conveyor 212 transfers the paving material from the hopper 202 to the right auger 214 in the direction generally parallel to the direction of travel of the machine 100. The right conveyor 212 may be any conveying element known in the art, such as a belt type conveyor, a feeder bar type conveyor, and so on. The right auger 214 is adapted to distribute the paving material in front of the assembly 108 and laterally in the direction generally perpendicular to the direction of travel of the machine 100. The right auger 214 may be any conveying element known in the art, such as a screw type conveyor, a rotating type conveyor, and so on.

Figure 3:
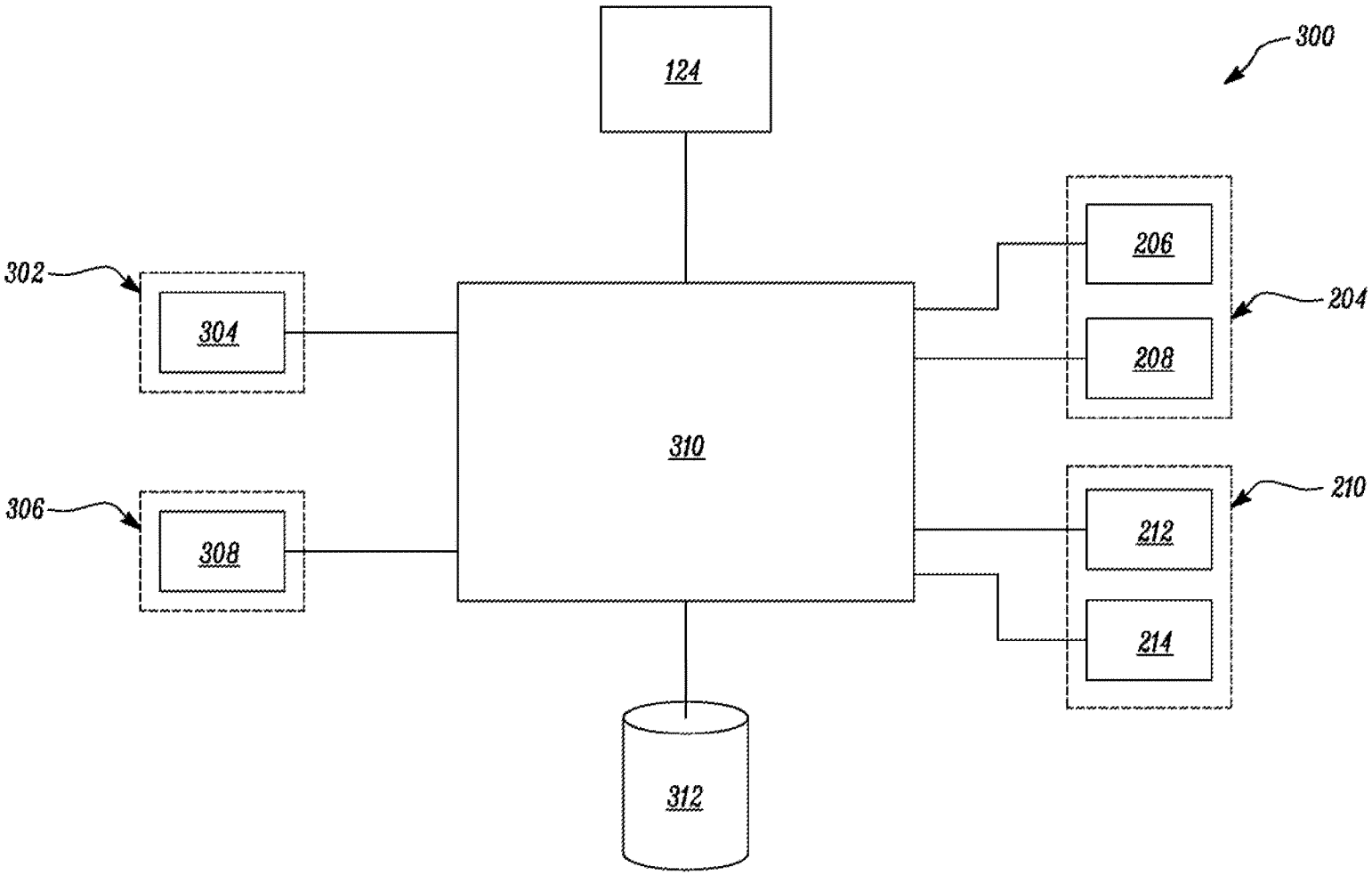
FIG. 3 is a schematic representation of a material feed system of the machine of FIG. 1, according to one embodiment of the present disclosure.

The present disclosure relates to a control system for the system 128. FIG. 3 shows a schematic representation of one embodiment of a control system 300. More specifically, the illustrated embodiment represents a two-sensor configuration of the control system 300. The control system 300 includes a first sensor assembly 302. The first sensor assembly 302 is provided in association with the left auger 208. Accordingly, in the illustrated embodiment, the first sensor assembly 302 is a left auger sensor 304. The left auger sensor 304 is configured to generate a signal indicative of an amount of paving material in the left mechanism 204 and, more specifically, adjacent to the left auger 208. In one embodiment, the left auger sensor 304 may be a contact type material feed sensor, such as a paddle type feed sensor. In another embodiment, the left auger sensor 304 may be a non-contact type material feed sensor, such as a sonic type feed sensor. It should be understood, however, that other known sensor types may be utilized to determine the amount of paving material in the left mechanism 204.

The control system 300 also includes a second sensor assembly 306. The second sensor assembly 306 is provided in association with the right auger 214. Accordingly, in the illustrated embodiment, the second sensor assembly 306 is a right auger sensor 308. The right auger sensor 308 is configured to generate a signal indicative of an amount of paving material in the right mechanism 210 and, more specifically, adjacent to the right auger 214. In one embodiment, the right auger sensor 308 may be a contact type material feed sensor, such as a paddle type feed sensor. In another embodiment, the right auger sensor 308 may be a non-contact type material feed sensor, such as a sonic type feed sensor. It should be understood, however, that other known sensor types may be utilized to determine the amount of paving material in the left mechanism 210.

The control system 300 also includes a controller 310. The controller 310 may be any control unit known in the art configured to perform various functions of the control system 300. In one embodiment, the controller 310 may be a dedicated control unit configured to perform functions related to the control system 300. In another embodiment, the controller 310 may be a Machine Control Unit (MCU) or an Electronic Control Module (ECM) associated with the machine 100, an Engine Control Unit (ECU) associated with the engine, and so on, configured to perform functions related to the control system 300.

The controller 310 is communicably coupled to each of the left auger sensor 304, the left auger 208, the left conveyor 206, the right auger sensor 308, the right auger 214, and the right conveyor 212. More specifically, in one embodiment, the controller 310 may be communicably coupled to an electronic displacement control unit (not shown) of a variable displacement piston pump (not shown) associated with each of the left auger 208, the left conveyor 206, the right auger 214, and the right conveyor 212. In another embodiment, the controller 310 may be communicably coupled to an electric motor (not shown) or other rotational actuator (not shown) associated with each of the left auger 208, the left conveyor 206, the right auger 214, and the right conveyor 212.

The controller 310 is configured to selectively receive the signal indicative of the amount of paving material in the left mechanism 204 from the left auger sensor 304. The controller 310 is also configured to selectively receive the signal indicative of the amount of paving material in the right mechanism 210 from the right auger sensor 308. The controller 310 is further configured to control a speed of the left mechanism 204 and/or the right mechanism 210 independently with respect to one another. Also, the controller 310 is configured to selectively control the speed of the left mechanism 204 and/or the right mechanism 210 in a first mode and a second mode. The system 128 may be selectively operated in the first mode or the second mode using an operator input via the operator interface 124.

The first mode represents a fully automated mode of the system 128. In the first mode, the speed of the left mechanism 204 is controlled based, at least in part, on the signal received from the left auger sensor 304. More specifically, in the first mode, a speed of the left auger 208 is controlled by the controller 310 based on the signal received from the left auger sensor 304. Also, a speed of the left conveyor 206 is controlled by the controller 310 as a function of the speed of the left auger 208 in the first mode. It should be noted that, in such a situation, the controller 310 may automatically control the speed of the left conveyor 206 based on the speed of the left auger 208, or the speed of the left conveyor 206 may be selectively adjusted by the operator in order to be variably dependent on the speed of the left auger 208 based on the operator input via the operator interface 124 or a conveyor ratio dial (not shown).

The speed of the left conveyor 206 may be controlled as the function of the speed of the left auger 208 based on a dataset (not shown). The dataset may be stored in a database 312 communicably coupled to the controller 310 or a memory (not shown) of the controller 310. In one embodiment, the dataset may include different values of the speed of the left conveyor 206 for varying values of the speed of the left auger 208. In another embodiment, the dataset may include a mathematical model representing a mathematical relationship between the speed of the left conveyor 206 and the speed of the left auger 208. In such a situation, the controller 310 may derive the speed of the left conveyor 206 based on the speed of the left auger 208 using the mathematical model.

Also, in the first mode, the speed of the right mechanism 210 is controlled based, at least in part, on the signal received from the right auger sensor 308. The speed of the right mechanism 210 is controlled independently with respect to the speed of the left mechanism 204. More specifically, in the first mode, a speed of the right auger 214 is controlled by the controller 310 based on the signal received from the right auger sensor 308. Also, a speed of the right conveyor 212 is controlled by the controller 310 as a function of the speed of the right auger 214 in the first mode. It should be noted that, in such a situation, the controller 310 may automatically control the speed of the right conveyor 212 based on the speed of the right auger 214, or the speed of the right conveyor 212 may be selectively adjusted by the operator in order to be variably dependent on the speed of the right auger 214 based on the operator input via the operator interface 124 or the conveyor ratio dial.

The speed of the right conveyor 212 may be controlled as the function of the speed of the right auger 214 based on a dataset. The dataset may be stored in the database 312 or the memory of the controller 310. In one embodiment, the dataset may include different values of the speed of the right conveyor 212 for varying values of the speed of the right auger 214. In another embodiment, the dataset may include a mathematical model representing a mathematical relationship between the speed of the right conveyor 212 and the speed of the right auger 214. In such a situation, the controller 310 may derive the speed of the right conveyor 212 based on the speed of the right auger 214 using the mathematical model.

The second mode represents a partially automated mode of the system 128. In the second mode, the speed of one of the left mechanism 204 and the right mechanism 210 is controlled based, at least in part, on the signal received from the left auger sensor 304 and the right auger sensor 308 respectively, such as in the first mode. Also, the speed of other of the left mechanism 204 and the right mechanism 210 is manually set based on the operator input.

More specifically, in the second mode, the controller 310 is configured to control the speed of one of the left auger 208 and the right auger 214 based, at least in part, on the signals received from the left auger sensor 304 and the right auger sensor 308 respectively, such as in the first mode. The controller 310 is also configured to control the speed of one of the left conveyor 206 and the right conveyor 212 based, at least in part, as the function of the speed of one of the left auger 208 and the right auger 214 respectively.

Further, the speed of other of the left auger 208 and the right auger 214 is manually set based on the operator input and independently with respect to one another. Also, in one embodiment, the speed of other of the left conveyor 206 and the right conveyor 212 is selectively controlled based, at least in part, on the function of the speed of the other of the left auger 208 and the right auger 214 respectively. In another embodiment, the speed of the other of the left conveyor 206 and the right conveyor 212 is manually set based on the operator input.

For example, in a situation when the left auger sensor 304 may be functional, and the right auger sensor 308 may be broken, damaged, or non-functional, the second mode may be selected by the operator and the left mechanism 204 may be operated automatically and the right mechanism 210 may be operated partially automatically or manually and independently with respect to the left mechanism 204. In such a situation, the controller 310 may receive the signal indicative of the amount of paving material in the left mechanism 204 from the left auger sensor 304. Accordingly, the controller 310 may control the speed of the left auger 208 based on the received signal. The controller 310 may further control the speed of the left conveyor 206 as the function of the speed of the left auger 208.

Further, in such a situation, the controller 310 may control the speed of the right auger 214 based on the operator input and independently with respect to the left auger 208 and/or the left conveyor 206. In one embodiment, the controller 310 may control the speed of the right conveyor 212 as the function of the speed of the right auger 214. In another embodiment, the controller 310 may control the speed of the right conveyor 212 based on the operator input and independently with respect to the right auger 214, the left conveyor 206, and/or the left auger 208.

Similarly, in another situation when the right auger sensor 308 may be functional, and the left auger sensor 304 may be broken, damaged, or non-functional, the right mechanism 210 may be operated automatically and the left mechanism 204 may be operated partially automatically or manually and independently with respect to the right mechanism 210. In such a situation, the controller 310 may receive the signal indicative of the amount of paving material in the right mechanism 210 from the right auger sensor 308. Accordingly, the controller 310 may control the speed of the right auger 214 based on the received signal. The controller 310 may further control the speed of the right conveyor 212 as the function of the speed of the right auger 214.

Further, in such a situation, the controller 310 may control the speed of the left auger 208 based on the operator input and independently with respect to the right auger 214 and/or the right conveyor 212. In one embodiment, the controller 310 may control the speed of the left conveyor 206 as the function of the speed of the left auger 208. In another embodiment, the controller 310 may control the speed of the left conveyor 206 based on the operator input and independently with respect to the left auger 208, the right conveyor 212, and/or the right auger 214.

In yet another situation, when each of the left auger sensor 304 and the right auger sensor 308 may be broken, damaged, or non-functional, each of the left mechanism 204 and the right mechanism 210 may be operated manually and independently with respect to one another. More specifically, the controller 310 may control the speed of each of the left auger 208 and the left conveyor 206 based on the operator input and independently with respect to one another. Also, the controller 310 may control the speed of each of the right auger 214 and the right conveyor 212 based on the operator input and independently with respect to one another and each of the left auger 208 and the left conveyor 206.

Figure 4:
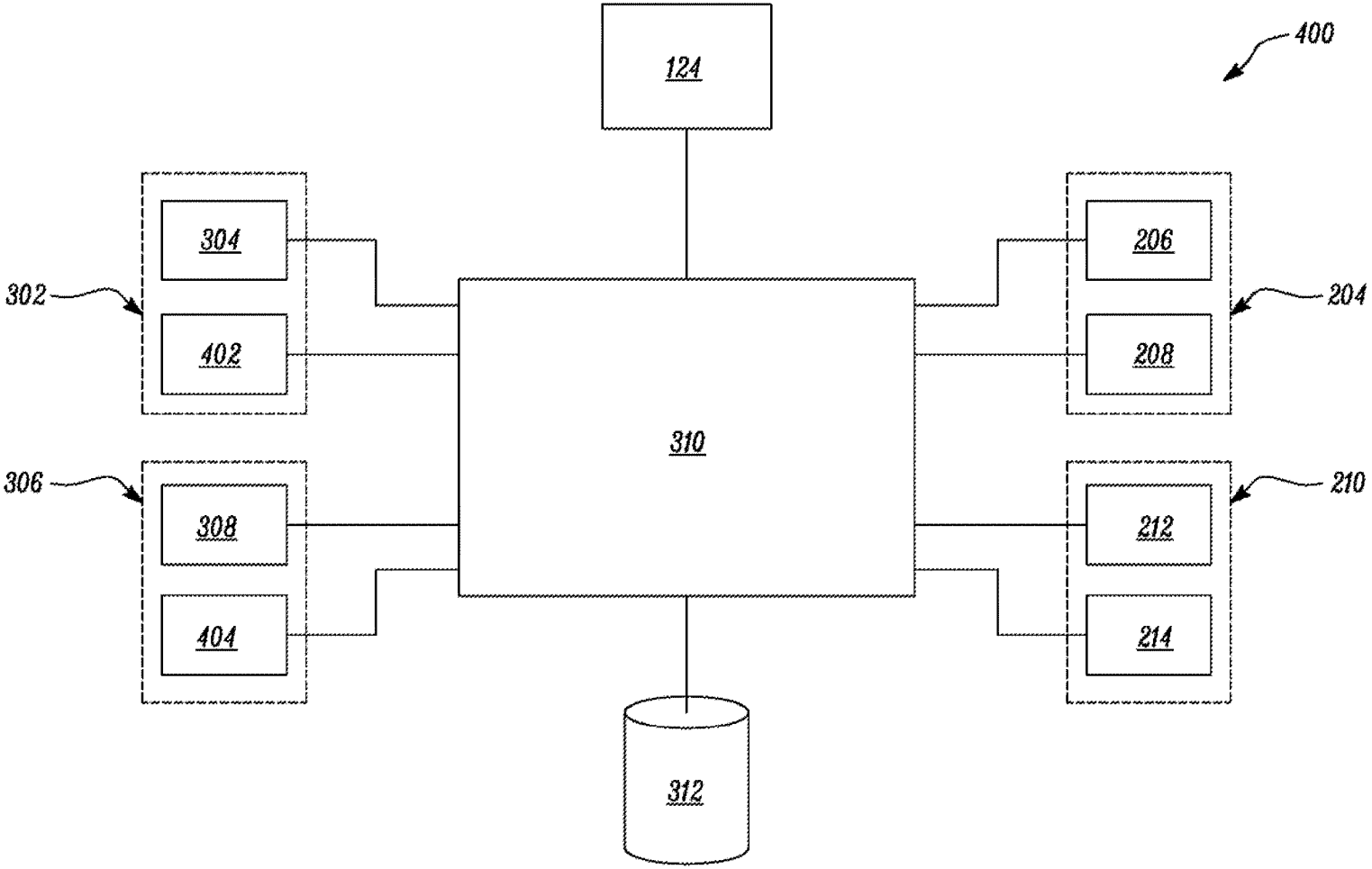
FIG. 4 is another schematic representation of a material feed system of the machine of FIG. 1, according to another embodiment of the present disclosure.

Referring to FIG. 4, a schematic representation of another embodiment of the control system 400 is illustrated. More specifically, the illustrated embodiment represents a four-sensor configuration of the control system 400. The control system 400 includes the first sensor assembly 302. The first sensor assembly 302 is provided in association with each of the left auger 208 and the left conveyor 206. Accordingly, in the illustrated embodiment, the first sensor assembly 302 includes the left auger sensor 304 and a left conveyor sensor 402. The left conveyor sensor 402 is configured to generate a signal indicative of an amount of paving material in the left mechanism 204 and, more specifically, adjacent to the left conveyor 206. In one embodiment, the left conveyor sensor 402 may be a contact type material feed sensor, such as a paddle type feed sensor. In another embodiment, the left conveyor sensor 402 may be a non-contact type material feed sensor, such as a sonic type feed sensor. It should be understood, however, that other known sensor types may be utilized to determine the amount of paving material in the left mechanism 204.

The control system 400 also includes the second sensor assembly 306. The second sensor assembly 306 is provided in association with each of the right auger 214 and the right conveyor 212. Accordingly, in the illustrated embodiment, the second sensor assembly 306 is the right auger sensor 308 and a right conveyor sensor 404. The right conveyor sensor 404 is configured to generate a signal indicative of an amount of paving material in the right mechanism 210 and, more specifically, adjacent to the right conveyor 212. In one embodiment, the right conveyor sensor 404 may be a contact type material feed sensor, such as a paddle type feed sensor. In another embodiment, the right conveyor sensor 404 may be a non-contact type material feed sensor, such as a sonic type feed sensor. It should be understood, however, that other known sensor types may be utilized to determine an amount of paving material in the left mechanism 210.

The control system 400 also includes the controller 310. The controller 310 is configured to selectively receive the signal indicative of the amount of paving material in the left mechanism 204 from the first sensor assembly 302, including the left auger sensor 304 and/or the left conveyor sensor 402. The controller 310 is also configured to selectively receive the signal indicative of the amount of paving material in the right mechanism 210 from the second sensor assembly 306, including the right auger sensor 308 and/or the right conveyor sensor 404. Based on the received signals, the controller 310 is further configured to control the speed of the left mechanism 204 and/or the right mechanism 210 independently with respect to one another. Also, the controller 310 is configured to selectively control the speed of the left mechanism 204 and/or the right mechanism 210 in the first mode and the second mode. The system 128 may be selectively operated in the first mode or the second mode using the operator input via the operator interface 124.

The first mode represents the fully automated mode of the system 128. In the first mode, the speed of the left mechanism 204 is controlled by the signal received from the first sensor assembly 302, including the left auger sensor 304 and/or the left conveyor sensor 402. More specifically, in one embodiment, the speed of the left auger 208 is controlled by the controller 310 based on the signal received from the left auger sensor 304. In such a situation, the speed of the left conveyor 206 is controlled by the controller 310 as the function of the speed of the left auger 208 in the first mode.

In another embodiment, the speed of the left conveyor 206 is controlled by the controller 310 based on the signal received from the left conveyor sensor 402. In such a situation, the speed of the left auger 208 is controlled by the controller 310 as a function of the speed of the left conveyor 206. It should be noted that, in such a situation, the controller 310 may automatically control the speed of the left auger 208 based on the speed of the left conveyor 206, or the speed of the left auger 208 may be selectively adjusted by the operator in order to be variably dependent on the speed of the left conveyor 206 based on the operator input via the operator interface 124 or the conveyor ratio dial. In yet another embodiment, the speed of each of the left auger 208 and the left conveyor 206 is controlled independently with respect to one another by the controller 310 based on the signals received from each of the left auger sensor 304 and the left conveyor sensor 402 respectively.

The speed of the left auger 208 may be controlled as the function of the speed of the left conveyor 206 based on a dataset. The dataset may be stored in the database 312 or the memory of the controller 310. In one embodiment, the dataset may include different values of the speed of the left auger 208 for varying values of the speed of the left conveyor 206. In another embodiment, the dataset may include a mathematical model representing a mathematical relationship between the speed of the left auger 208 and the speed of the left conveyor 206. In such a situation, the controller 310 may derive the speed of the left auger 208 based on the speed of the left conveyor 206 using the mathematical model.

Also, in the first mode, the speed of the right mechanism 210 is controlled based, at least in part, on the signal received from the second sensor assembly 306, including the right auger sensor 308 and/or the right conveyor sensor 404. The speed of the right mechanism 210 is controlled independently with respect to the speed of the left mechanism 204. More specifically, in one embodiment, the speed of the right auger 214 is controlled by the controller 310 based on the signal received from the right auger sensor 308. In such a situation, the speed of the right conveyor 212 is controlled by the controller 310 as the function of the speed of the right auger 214 in the first mode.

In another embodiment, the speed of the right conveyor 212 is controlled by the controller 310 based on the signal received from the right conveyor sensor 404. In such a situation, the speed of the right auger 214 is controlled by the controller 310 as a function of the speed of the right conveyor 212. It should be noted that, in such a situation, the controller 310 may automatically control the speed of the right auger 214 based on the speed of the right conveyor 212, or the speed of the right auger 214 may be selectively adjusted by the operator in order to be variably dependent on the speed of the right conveyor 212 based on the operator input via the operator interface 124 or the conveyor ratio dial. In yet another embodiment, the speed of each of the right auger 214 and the right conveyor 212 is controlled independently with respect to one another by the controller 310 based on the signals received from each of the right auger sensor 308 and the right conveyor sensor 404 respectively.

The speed of the right auger 214 may be controlled as the function of the speed of the right conveyor 212 based on a dataset. The dataset may be stored in the database 312 or the memory of the controller 310. In one embodiment, the dataset may include different values of the speed of the right auger 214 for varying values of the speed of the right conveyor 212. In another embodiment, the dataset may include a mathematical model representing a mathematical relationship between the speed of the right auger 214 and the speed of the right conveyor 212. In such a situation, the controller 310 may derive the speed of the right auger 214 based on the speed of the right conveyor 212 using the mathematical model.

The second mode represents the partially automated mode of the system 128. In one embodiment, in the second mode, the speed of one of the left mechanism 204 and the right mechanism 210 is controlled based, at least in part, on the signal received from the first sensor assembly 302, including the left auger sensor 304 and/or the left conveyor sensor 402, and the second sensor assembly 306, including the right auger sensor 308 and the right conveyor sensor 404 respectively. Also, the speed of other of the left mechanism 204 and the right mechanism 210 is manually set based on the operator input.

More specifically, in the second mode, the controller 310 is configured to control the speed of one of the left auger 208 and the right auger 214 based, at least in part, on the signals received from the left auger sensor 304 and the right auger sensor 308 respectively. In such a situation, the controller 310 is configured to control the speed of one of the left conveyor 206 and the right conveyor 212 based, at least in part, as the function of the speed of one of the left auger 208 and the right auger 214 respectively.

Further, the speed of the left auger 208 and the right auger 214 is manually set based on the operator input and independently with respect to one another. In such a situation, in one embodiment, the speed of other of the left conveyor 206 and the right conveyor 212 is selectively controlled based, at least in part, on the function of the speed of the left auger 208 and the right auger 214 respectively. In another embodiment, the speed of the left conveyor 206 and the right conveyor 212 is selectively controlled based, at least in part, on the operator input.

For example, in a situation when the left auger sensor 304 may be functional, and the right auger sensor 308 may be broken, damaged, or non-functional, the second mode may be selected by the operator and the left mechanism 204 may be operated automatically and the right mechanism 210 may be operated partially automatically or manually and independently with respect to the left mechanism 204. In such a situation, the controller 310 may receive the signal indicative of the amount of paving material in the left mechanism 204 from the left auger sensor 304. Accordingly, the controller 310 may control the speed of the left auger 208 based on the received signal. The controller 310 may further control the speed of the left conveyor 206 as the function of the speed of the left auger 208.

Further, in such a situation, the controller 310 may control the speed of the right auger 214 based on the operator input and independently with respect to the left auger 208 and/or the left conveyor 206. In one embodiment, the controller 310 may control the speed of the right conveyor 212 as the function of the speed of the right auger 214. In another embodiment, the controller 310 may control the speed of the right conveyor 212 based on the operator input and independently with respect to the right auger 214, the left conveyor 206, and/or the left auger 208.

Similarly, in another situation when the right auger sensor 308 may be functional, and the left auger sensor 304 may be broken, damaged, or non-functional, the right mechanism 210 may be operated automatically and the left mechanism 204 may be operated partially automatically or manually and independently with respect to the right mechanism 210. In such a situation, the controller 310 may receive the signal indicative of the amount of paving material in the right mechanism 210 from the right auger sensor 308. Accordingly, the controller 310 may control the speed of the right auger 214 based on the received signal. The controller 310 may further control the speed of the right conveyor 212 as the function of the speed of the right auger 214.

Further, in such a situation, the controller 310 may control the speed of the left auger 208 based on the operator input and independently with respect to the right auger 214 and/or the right conveyor 212. In one embodiment, the controller 310 may control the speed of the left conveyor 206 as the function of the speed of the left auger 208. In another embodiment, the controller 310 may control the speed of the left conveyor 206 based on the operator input and independently with respect to the left auger 208, the right conveyor 212, and/or the right auger 214.

In another embodiment, in the second mode, the controller 310 is configured to control the speed of one of the left conveyor 206 and the right conveyor 212 based, at least in part, on the signals received from the left conveyor sensor 402 and the right conveyor sensor 404 respectively. In such a situation, the controller 310 is configured to control the speed of one of the left auger 208 and the right auger 214 based, at least in part, as the function of the speed of one of the left conveyor 206 and the right conveyor 212 respectively.

Further, the speed of the other of the left conveyor 206 and the right conveyor 212 is manually set based on the operator input and independently with respect to one another. In such a situation, in one embodiment, the speed of other of the left auger 208 and the right auger 214 is selectively controlled based, at least in part, on the function of the speed of the other of the left conveyor 206 and the right conveyor 212 respectively. In another embodiment, the speed of the other of the left auger 208 and the right auger 214 is manually set based on the operator input.

For example, when the left conveyor sensor 402 may be functional, and the right conveyor sensor 404 may be broken, damaged, or non-functional, the left mechanism 204 may be operated automatically and the right mechanism 210 may be operated partially automatically or manually and independently with respect to the left mechanism 204. In such a situation, the controller 310 may receive the signal indicative of the amount of paving material in the left mechanism 204 from the left conveyor sensor 402. Accordingly, the controller 310 may control the speed of the left conveyor 206 based on the received signal. The controller 310 may further control the speed of the left auger 208 as the function of the speed of the left conveyor 206.

Further, in such a situation, the controller 310 may control the speed of the right conveyor 212 based on the operator input and independently with respect to the left conveyor 206 and/or the left auger 208. In one embodiment, the controller 310 may control the speed of the right auger 214 as the function of the speed of the right conveyor 212. In another embodiment, the controller 310 may control the speed of the right auger 214 based on the operator input and independently with respect to the right conveyor 212, the left auger 208, and/or the left conveyor 206.

Similarly, in another situation when the right conveyor sensor 404 may be functional, and the left conveyor sensor 402 may be broken, damaged, or non-functional, the right mechanism 210 may be operated automatically and the left mechanism 204 may be operated partially automatically or manually and independently with respect to the right mechanism 210. In such a situation, the controller 310 may receive the signal indicative of the amount of paving material in the right mechanism 210 from the right conveyor sensor 404. Accordingly, the controller 310 may control the speed of the right conveyor 212 based on the received signal. The controller 310 may further control the speed of the right auger 214 as the function of the speed of the right conveyor 212.

Further, in such a situation, the controller 310 may control the speed of the left conveyor 206 based on the operator input and independently with respect to the right conveyor 212 and/or the right auger 214. In one embodiment, the controller 310 may control the speed of the left auger 208 as the function of the speed of the left conveyor 206. In another embodiment, the controller 310 may control the speed of the left auger 208 based on the operator input and independently with respect to the left conveyor 206, the right auger 214, and/or the right conveyor 212.

In yet another situation, when each of the left auger sensor 304, the left conveyor sensor 402, the right auger sensor 308, and the right conveyor sensor 404 may be broken, damaged, or non-functional, each of the left mechanism 204 and the right mechanism 210 may be operated manually and independently with respect to one another. More specifically, the controller 310 may control the speed of each of the left auger 208 and the left conveyor 206 based on the operator input and independently with respect to one another. Also, the controller 310 may control the speed of each of the right auger 214 and the right conveyor 212 based on the operator input and independently with respect to one another and each of the left auger 208 and the left conveyor 206.

In yet another situation, when each of the left auger sensor 304, the left conveyor sensor 402, the right auger sensor 308, and the right conveyor sensor 404 may be functional, each of the left mechanism 204 and the right mechanism 210 may be operated fully automatically and independently with respect to one another. More specifically, the controller 310 may control the speed of each of the left auger 208 and the left conveyor 206 based on the signals received from the left auger sensor 304 and the left conveyor sensor 402 respectively and independently with respect to one another. Also, the controller 310 may control the speed of each of the right auger 214 and the right conveyor 212 based on the signals received from the right auger sensor 308 and the right conveyor sensor 404 respectively and independently with respect to one another and each of the left auger 208 and the left conveyor 206.

INDUSTRIAL APPLICABILITY

Figure 5:
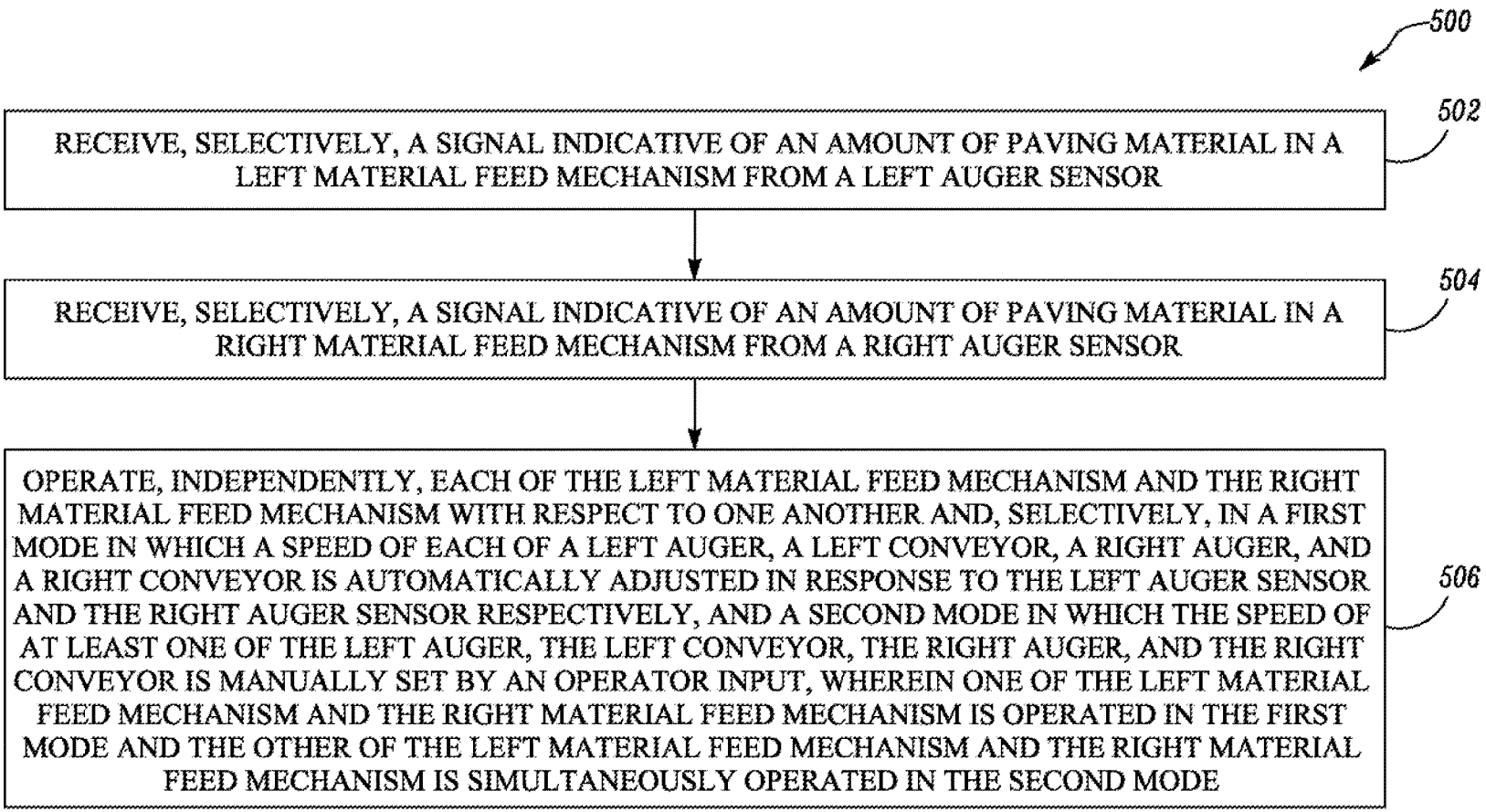
FIG. 5 is a flowchart illustrating a method of working of the material feed system of FIG. 3, according to an embodiment of the present disclosure.

The present disclosure relates to a method of working of the control system 300, 400. Referring to FIG. 5, a method 500 of working of the control system 300 is illustrated. More specifically, the method 500 represents the two-sensor configuration of the control system 300 as described in relation to FIG. 3. At step 502, the controller 310 selectively receives the signal indicative of the amount of paving material in the left mechanism 204 from the left auger sensor 304. At step 504, the controller 310 selectively receives the signal indicative of the amount of paving material in the right mechanism 210 from the right auger sensor 308.

At step 506, the controller 310 operates each of the left mechanism 204 and the right mechanism 210, selectively, in the first mode and the second mode. In the first mode, the speed of each of the left auger 208, the left conveyor 206, the right auger 214, and the right conveyor 212 is automatically adjusted in response to the left auger sensor 304 and the right auger sensor 308 respectively. In the second mode, the speed of the left auger 208, the left conveyor 206, the right auger 214, and/or the right conveyor 212 is manually set by the operator input, one of the left mechanism 204 and the right mechanism 210 is operated in the first mode, and the other of the left mechanism 204 and the right mechanism 210 is simultaneously operated in the second mode.

Accordingly, in the two-sensor configuration, the system 128 may be operated automatically in the first mode. As such, each of the left auger 208, the left conveyor 206, the right auger 214, and the right conveyor 212 may be operated automatically. In situations, when one of the left auger sensor 304 or the right auger sensor 308 may be damaged, the system 128 may be operated partially automatically in the second mode. As such, one of the left mechanism 204 and the right mechanism 210 having a functional sensor may be operated fully automatically in the first mode, whereas other of the left mechanism 204 and the right mechanism 210 having a damaged sensor may be operated manually based on the operator input.

In situations, when each of the left auger sensor 304 and the right auger sensor 308 may be damaged, the system 128 may be operated manually. As such, each of the left mechanism 204 and the right mechanism 210 may be operated manually based on the operator input. Such an arrangement may provide flexibility to operate the system 128 on different levels of automation based on sensor availability, in turn, reducing operator dependence, operator fatigue, operational errors, improved process quality, reduced machine downtime, and so on.

Figure 6:
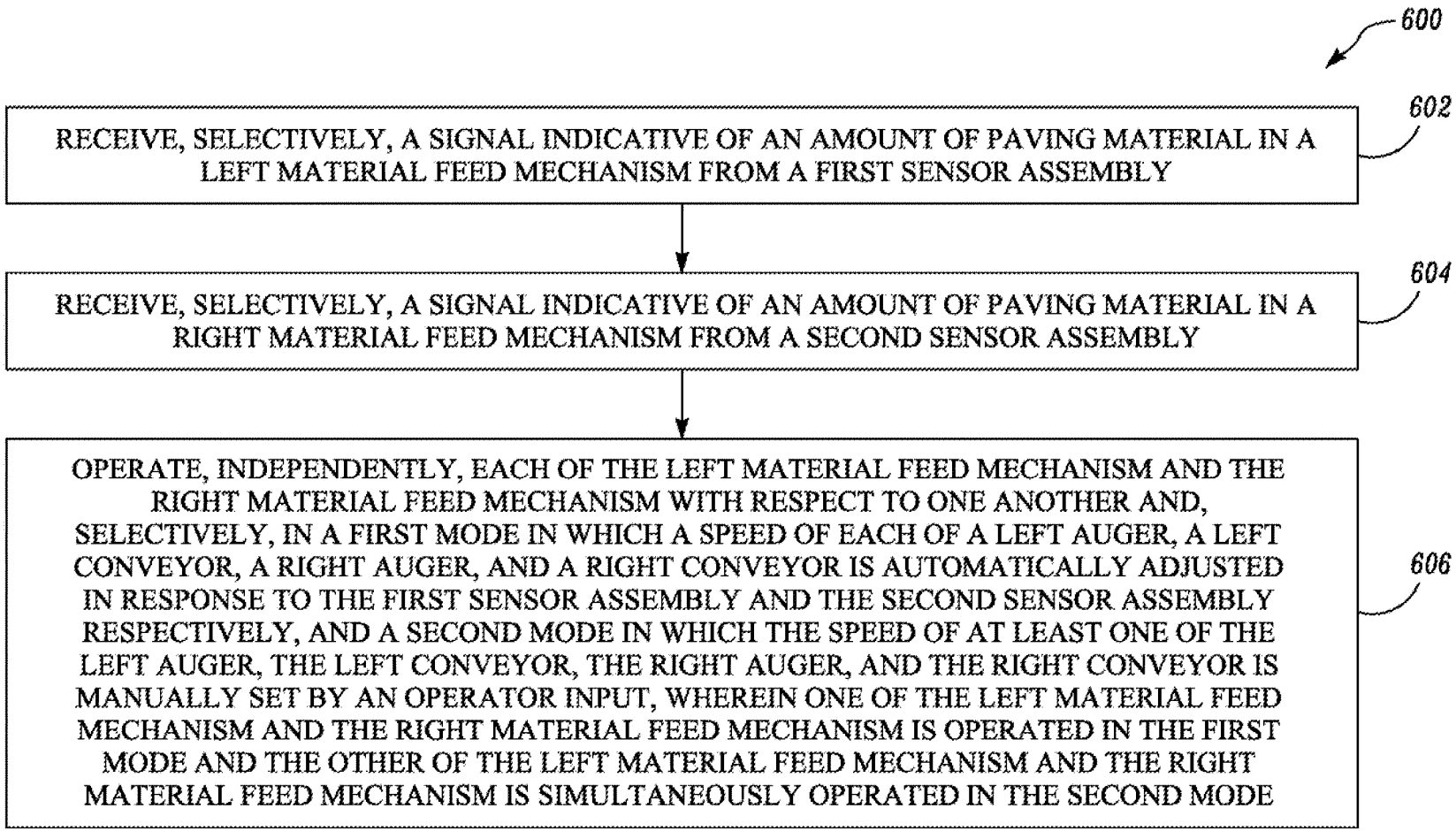
FIG. 6 is a flowchart illustrating a method of working of the material feed system of FIG. 4, according to another embodiment of the present disclosure.

Referring to FIG. 6, another method 600 of working of the control system 400 is illustrated. More specifically, the method 600 represents the four-sensor configuration of the control system 400 as described in relation to FIG. 4. At step 602, the controller 310 selectively receives the signal indicative of the amount of paving material in the left mechanism 204 from the first sensor assembly 302, including the left auger sensor 304 and/or the left conveyor sensor 402. At step 604, the controller 310 selectively receives the signal indicative of the amount of paving material in the right mechanism 210 from the second sensor assembly 306, including the right auger sensor 308 and/or the right conveyor sensor 404.

At step 606, the controller 310 operates each of the left mechanism 204 and the right mechanism 210, selectively, in the first mode and the second mode. In the first mode, the speed of each of the left auger 208, the left conveyor 206, the right auger 214, and the right conveyor 212 is automatically adjusted in response to the first sensor assembly 302 and the second sensor assembly 306 respectively. In the second mode, the speed of the left auger 208, the left conveyor 206, the right auger 214, and/or the right conveyor 212 is manually set by the operator input, one of the left mechanism 204 and the right mechanism 210 is operated in the first mode, and the other of the left mechanism 204 and the right mechanism 210 is simultaneously operated in the second mode.

Accordingly, in the four-sensor configuration, the system 128 may be operated automatically in the first mode. As such, each of the left auger 208, the left conveyor 206, the right auger 214, and the right conveyor 212 may be operated automatically. In situations, when one of the left auger sensor 304 or the right auger sensor 308 may be damaged, the system 128 may be operated partially automatically in the second mode. As such, one of the left mechanism 204 and the right mechanism 210 having the functional sensor may be operated fully automatically in the first mode, whereas other of the left mechanism 204 and the right mechanism 210 having the damaged sensor may be operated manually based on the operator input.

In situations, when one of the left conveyor sensor 402 or the right conveyor sensor 404 may be damaged, the system 128 may be operated partially automatically in the second mode. As such, one of the left mechanism 204 and the right mechanism 210 having the functional sensor may be operated fully automatically in the first mode, whereas other of the left mechanism 204 and the right mechanism 210 having the damaged sensor may be operated manually based on the operator input.

In situations, when each of the left auger sensor 304, the left conveyor sensor 402, the right auger sensor 308, and the right conveyor sensor 404 may be damaged, the system 128 may be operated manually. As such, each of the left mechanism 204 and the right mechanism 210 may be operated manually based on the operator input. Such an arrangement may provide flexibility to operate the system 128 on different levels of automation based on sensor availability, in turn, reducing operator dependence, operator fatigue, operational errors, improved process quality, reduced machine downtime, and so on.

The control system 300, 400, in each of the two-sensor configuration and the four-sensor configuration, provides a simple, efficient, and cost-effective method for controlling the system 128 based on the number and/or availability of the sensors. As such, the system 128 may be operated in any of the two-sensor configuration, the four-sensor configuration, the first mode, the second mode, the fully automated mode, the partially automated mode, and/or the manual mode, based on application requirements. The control system 300, 400 employs components already available on the machine 100, such as the sensors, the controller 310, and so on, in turn, reducing system cost and complexity. Also, the control system 300, 400 may be retrofitted on any machine 100 with little or no modification to the existing system.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of the disclosure. Such embodiments should be understood to fall within the scope of the present disclosure as determined based upon the claims and any equivalents thereof.

What is claimed is:

1. A material feed system for a paving machine, the paving machine having a hopper for holding a volume of paving material, a left material feed mechanism including a left auger and a left conveyor provided in association with the left auger, a right material feed mechanism including a right auger and a right conveyor provided in association with the right auger, the material feed system comprising:

a first sensor assembly provided in association with one of the left auger and the left conveyor, the first sensor assembly configured to generate a signal indicative of an amount of paving material in the left material feed mechanism;

a second sensor assembly provided in association with one of the right auger and the right conveyor, the second sensor assembly configured to generate a signal indicative of an amount of paving material in the right material feed mechanism; and a controller communicably coupled to each of the first sensor assembly, the left auger, the left conveyor, the second sensor assembly, the right auger, and the right conveyor, the controller configured to:

receive, selectively, the signal indicative of the amount of paving material in the left material feed mechanism from the first sensor assembly;

receive, selectively, the signal indicative of the amount of paving material in the right material feed mechanism from the second sensor assembly; and operate, independently, each of the left material feed mechanism and the right material feed mechanism with respect to one another and, selectively, in a first mode in which a speed of each of the left auger, the left conveyor, the right auger, and the right conveyor is automatically adjusted in response to the first sensor assembly and the second sensor assembly respectively, and a second mode in which the speed of at least one of the left auger, the left conveyor, the right auger, and the right conveyor is manually set by an operator input with no input to the controller from at least one of the first sensor assembly or the second sensor assembly, wherein one of the left material feed mechanism and the right material feed mechanism is operated in the first mode and the other of the left material feed mechanism and the right material feed mechanism is simultaneously operated in the second mode.

2. The material feed system of claim 1, wherein, in the first mode, the controller is configured to:

control the speed of each of the left auger and the right auger based, at least in part, on the signals received from the first sensor assembly and the second sensor assembly respectively, and control the speed of each of the left conveyor and the right conveyor based, at least in part, on at least one of a function of the speed of each of the left auger and the right auger respectively, and the operator input.

3. The material feed, system of claim 1, wherein, in the first mode, the controller is configured to:

control the speed of each of the left conveyor and the right conveyor based, at least in part, on the signals received from the first sensor assembly and the second sensor assembly respectively, and control the speed of each of the left auger and the right auger based, at least in part, on at least one of a function of the speed of each of the left conveyor and the right conveyor respectively, and the operator input.

4. The material feed system of claim 1, wherein, in the first mode, the controller is configured to:

control the speed of each of the left auger and the left conveyor independently with respect to one another based, at least in part, on the signals received from the first sensor assembly, and control the speed of each of the right auger and the right conveyor independently with respect, to one another based, at least in part, on the signals received from the second sensor assembly.

5. The material feed system of claim 1, wherein, in the second mode, the controller is configured to:

control the speed of one of the left auger and the right auger based, at least in part, on the signals received from the first sensor assembly and the second sensor assembly respectively, control the speed of one of the left conveyor and the right conveyor based, at least in part, on at least one of a function of the speed of one of the left auger and the right, auger respectively, and the operator input, control the speed of one of the left auger and the right auger, selectively, based, at least in part, on the operator input, and control the speed of other of the left conveyor and the right conveyor, selectively, based, at least in part, on at least one of a function of the speed of the other of the left auger and the right auger respectively, and the operator input.

6. The material feed system of claim 1, wherein, in the second mode, the controller is configured to:

control the speed of one of the left conveyor and the right conveyor based, at least in part, on the signals received from the first sensor assembly and the second sensor assembly respectively, control the speed of one of the left auger and the right auger based, at least in part, on at least one of a function of the speed of one of the left conveyor and the right conveyor respectively, and the operator input, control the speed of other of the left conveyor and. the right conveyor, selectively, based, at least in part, on the operator input, and control the speed of other of the left auger and the right auger, selectively, based, at least in part, on at least one of a function of the speed of the other of the left conveyor and the right conveyor respectively, and the operator input.

7. The material feed system of claim 1, wherein the speed of at least one of the left auger, the left conveyor, the right auger, and the right, conveyor is controlled based, at least in part, on a predefined dataset.

8. The material feed system of claim 1, wherein:

the first sensor assembly includes at least one of a left auger sensor and a left conveyor sensor, and the second, sensor assembly includes at least one of a right auger sensor and a right conveyor sensor.

9. The material feed system of claim 1, wherein each of the first sensor assembly and the second sensor assembly is any one of a contact type material feed sensor and a non-contact type material feed sensor.

10. A method for controlling a material feed system associated with, a paving machine, the material feed system having a left material feed mechanism including a left auger arid a left conveyor, and a right material feed mechanism including a right auger and. a right conveyor, the method comprising:

receiving, selectively, a signal indicative of an amount of paving material in the left material feed mechanism from a first sensor assembly;

receiving, selectively, a signal indicative of an amount, of paving material in the right material feed mechanism from a second sensor assembly; and operating, independently, each of the left material feed mechanism and the right material feed mechanism with respect to one another and, selectively, in a first mode in which a speed of each of the left auger, the left conveyor, the right auger, and the right conveyor is automatically adjusted in response to the first sensor assembly and the second sensor assembly respectively, and a second mode in which the speed of at least one of the left auger, the left conveyor, the right auger, and the right conveyor is manually set by an operator input, wherein one of the left material feed mechanism and the right material feed mechanism is operated in the first mode and the other of the left material feed mechanism and the right material feed mechanism is simultaneously operated in the second mode.

11. The method of claim 10, wherein, in the first mode, the controller is configured to:

control the speed of each of the left auger and the right auger based, at least in part, on the signals received front the first sensor assembly and the second sensor assembly respectively, and control the speed of each of the left conveyor and the right conveyor based, at least in part, on at least one of a function of the speed of each of the left auger and the right auger respectively, and the operator input.

12. The method of claim 10, wherein, in the first mode, the controller is configured to:

control the speed of each of the left conveyor and the right conveyor based, at least in part, on the signals received from the first sensor assembly and the second sensor assembly respectively, and control the speed of each of the left auger and the right auger based, at least in part, on at least one of a function of the speed of each of the left conveyor and the right conveyor respectively, and the operator input.

13. The method of claim 10, wherein, in the first mode, the controller is configured to:

control the speed of each of the left auger and the left conveyor independently with respect to one another based, at least in part, on the signals received from the first sensor assembly, and control the speed of each of the right auger and the right conveyor independently with respect, to one another based, at least in part, on the signals received from the second sensor assembly.

14. The method of claim 10, wherein, in the second mode, the controller is configured to:

control the speed of one of the left auger and the right auger based, at least in part, on the signals received from the first sensor assembly and the second sensor assembly respectively, control the speed of one of the left conveyor and the right conveyor based, at least in part, on at least one of a function of the speed of one of the left auger and the right, auger respectively, and the operator input, control the speed of other of the left auger and the right auger, selectively, based, at least in part, on the operator input, and control the speed of other of the left conveyor and. the right conveyor, selectively, based, at least in part, on at least one of a function of the speed of the other of the left auger and the right auger respectively, and the operator input.

15. The method of claim 10, wherein, in the second mode, the controller is configured to:

control the speed of one of the left conveyor and the right conveyor based, at least in part, on the signals received from the first sensor assembly and the second sensor assembly respectively, control the speed of one of the left auger and the right auger based, at. least in part, on at least one of a function of the speed of one of the left conveyor and the right conveyor respectively, and the operator input, control the speed of other of the left conveyor and. the right conveyor, selectively, based, at least, in part, on the operator input, and control the speed of other of the left auger and the right auger, selectively, based, at least in part, on at least one of a function of the speed of the other of the left conveyor and the right conveyor respectively, and the operator input.

16. The method of claim 10, wherein the speed of at least one of the left auger, the left conveyor, the right auger, and the right conveyor is controlled based, at least in part, on a predefined dataset.

17. The method of claim 10, wherein:

the first sensor assembly includes at least one of a left auger sensor and a left conveyor sensor, and the second, sensor assembly includes at least one of a right auger sensor and a right conveyor sensor.

18. A method for controlling a material feed system associated with a paving machine, the material feed system having a left, material feed, mechanism including a left auger and a left conveyor, and a right material feed mechanism including a right auger and a right conveyor, the method comprising:

receiving, selectively, a signal indicative of an amount, of paving material in the left material feed mechanism from a left auger sensor, receiving, selectively, a signal Indicative of an amount of paving material in the right material feed mechanism from a right auger sensor; and operating, independently, each of the left material teed mechanism and the right, material feed mechanism with respect to one another and, selectively, in a first mode in which a speed of each of the left auger, the left conveyor, the right auger, and the right conveyor is automatically adjusted in response to the left auger sensor and. the right auger sensor respectively, and a second, mode in which the speed of at least one of the left auger, the left conveyor, the right auger, and the right conveyor is manually set by an operator input, wherein one of the left material feed mechanism and the right material feed mechanism is operated in the first mode and the other of the left material feed mechanism and. the right material feed mechanism is simultaneously operated in the second mode.

19. The method of claim 18, wherein, in the first mode, the controller is configured to:

control the speed of each of the left auger and the right auger based, at least in part, on the signals received from the left auger sensor and the right auger sensor respectively, and control the speed of each of the left conveyor arid the right conveyor based, at least in part, on at least one of a function of the speed of each of the left auger and the right auger respectively, and the operator input.

20. The method of claim 18, wherein, in the second mode, the controller is configured to:

control the speed of one of the left, auger and the right auger based, at least in part, on the signals received from the left auger sensor and the right auger sensor respectively, control the speed of one of the left conveyor and the right conveyor based, at least in part, on at least one of a function of the speed of one of the left auger and the right auger respectively, and the operator input, control the speed, of other of the left auger and the right auger, selectively, based, at least in part, on the operator input, and control the speed of other of the left conveyor and the right conveyor, selectively, based, at least in part, on at least one of a function of the speed of the other of the left auger and the right auger respectively, and the operator input.

* * * * *